US006937188B1

(12) United States Patent
Saunders et al.

(10) Patent No.: US 6,937,188 B1
(45) Date of Patent: Aug. 30, 2005

(54) SATELLITE ANTENNA INSTALLATION TOOL

(75) Inventors: Robert A. Saunders, Marietta, GA (US); Scott R. Swix, Duluth, GA (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 17 days.

(21) Appl. No.: 10/008,424

(22) Filed: Nov. 13, 2001

(51) Int. Cl.[7] ..... H01Q 3/00
(52) U.S. Cl. ..... 342/359
(58) Field of Search ..... 342/359; 543/203

(56) References Cited

U.S. PATENT DOCUMENTS

| | | | | |
|---|---|---|---|---|
| 4,126,865 | A | | 11/1978 | Longhurst et al. |
| 4,237,465 | A | | 12/1980 | Shibano et al. |
| 4,495,706 | A | | 1/1985 | Kaminski |
| 4,626,864 | A | | 12/1986 | Micklethwaite |
| 4,691,207 | A | | 9/1987 | Timineri |
| 4,833,932 | A | | 5/1989 | Rogers |
| 4,990,924 | A | | 2/1991 | McMullen et al. |
| 5,065,969 | A | | 11/1991 | McLean |
| 5,088,672 | A | | 2/1992 | Neuendorf et al. |
| 5,276,972 | A | | 1/1994 | Staney |
| 5,351,060 | A | | 9/1994 | Bayne |
| 5,376,941 | A | * | 12/1994 | Fukazawa et al. ..... 342/359 |
| 5,463,403 | A | | 10/1995 | Walker et al. |
| 5,473,335 | A | | 12/1995 | Tines |
| 5,561,433 | A | | 10/1996 | Chaney et al. |
| 5,621,418 | A | | 4/1997 | Maloney |
| 5,646,638 | A | | 7/1997 | Winegard et al. |
| 5,647,134 | A | | 7/1997 | Chou |
| 5,664,752 | A | | 9/1997 | Matthiessen et al. |
| 5,734,356 | A | | 3/1998 | Chang |
| 5,760,739 | A | | 6/1998 | Pauli |
| 5,829,121 | A | | 11/1998 | Shoemaker et al. |
| 5,870,059 | A | | 2/1999 | Reynolds |
| 5,884,199 | A | | 3/1999 | Maki |
| 5,894,674 | A | | 4/1999 | Feldman |
| 5,903,237 | A | | 5/1999 | Crosby et al. |
| 5,915,020 | A | * | 6/1999 | Tilford et al. ..... 455/3.02 |
| 5,920,291 | A | | 7/1999 | Bosley |
| 5,923,288 | A | | 7/1999 | Pedlow, Jr. |
| 5,933,123 | A | | 8/1999 | Kaul |
| 5,940,028 | A | | 8/1999 | Iwamura |
| 5,945,945 | A | | 8/1999 | Wagner et al. |
| D413,603 | S | | 9/1999 | Inoue |
| 5,977,922 | A | | 11/1999 | Hemmingsen, II |
| 5,992,809 | A | | 11/1999 | Sweere et al. |
| 5,999,139 | A | | 12/1999 | Benjamin et al. |
| 6,008,769 | A | | 12/1999 | Palmiter et al. |
| 6,011,511 | A | | 1/2000 | Chuong et al. |
| 6,023,247 | A | | 2/2000 | Rodeffer |
| 6,031,508 | A | | 2/2000 | Ishizuka et al. |
| 6,037,913 | A | | 3/2000 | Johnson |
| 6,208,314 | B1 | | 3/2001 | Bourquin |
| 6,216,266 | B1 | * | 4/2001 | Eastman et al. ..... 725/72 |
| 6,229,480 | B1 | * | 5/2001 | Shintani ..... 342/359 |
| 6,262,687 | B1 | | 7/2001 | Bai et al. |
| 6,285,338 | B1 | | 9/2001 | Bai et al. |
| 6,331,839 | B1 | | 12/2001 | Grenell |
| D453,151 | S | | 1/2002 | Weaver |
| 6,337,658 | B1 | | 1/2002 | Tong et al. |

(Continued)

FOREIGN PATENT DOCUMENTS

| | | | | |
|---|---|---|---|---|
| EP | 000818923 A2 | * | 1/1998 | ..... H04N/5/44 |
| EP | 1014481 A1 | * | 12/1999 | ..... H01Q/1/12 |
| EP | 1 014 481 A1 | * | 6/2000 | ..... H01Q/3/00 |
| WO | WO 00/24083 A1 | * | 4/2000 | ..... H01Q/1/12 |

*Primary Examiner*—Gregory C. Issing
(74) *Attorney, Agent, or Firm*—Merchant & Gould

(57) ABSTRACT

A portable device for assessing the degree of alignment between antenna and a satellite. In one embodiment, the device includes a portable housing that includes components for producing an audio and/or visual indication of the antenna's alignment with the satellite. The device may be self-contained and provide power to the antenna's frequency converter during the alignment process.

22 Claims, 10 Drawing Sheets

U.S. PATENT DOCUMENTS

| | | | |
|---|---|---|---|
| D453,330 | S | 2/2002 | Weaver |
| 6,480,161 | B2 | 11/2002 | Watson |
| 6,484,987 | B2 | 11/2002 | Weaver |
| 6,486,851 | B2 | 11/2002 | Weaver |
| 6,507,325 | B2 | 1/2003 | Matz et al. |
| 6,559,806 | B1 | 5/2003 | Watson |
| 2002/0083573 | A1 | 7/2002 | Matz et al. |
| 2002/0083574 | A1 | 7/2002 | Matz et al. |
| 2002/0084941 | A1 | 7/2002 | Matz et al. |
| 2002/0084946 | A1 | 7/2002 | Matz et al. |

* cited by examiner

SATELLITE ANTENNA INSTALLATION TOOL

BACKGROUND OF THE INVENTION

1. Field of the Invention

The subject invention relates to alignment devices and, more particularly, to devices for aligning an antenna with a satellite.

2. Description of the Invention Background

The advent of the television can be traced as far back to the end of the nineteenth century and beginning of the twentieth century. However, it wasn't until 1923 and 1924, when Vladimir Kosma Zworykin invented the iconoscope, a device that permitted pictures to be electronically broken down into hundreds of thousands of components for transmission, and the kinescope, a television signal receiver, did the concept of television become a reality. Zworykin continued to improve those early inventions and television was reportedly first showcased to the world at the 1939 World's Fair in New York, where regular broadcasting began.

Over the years, many improvements to televisions and devices and methods for transmitting and receiving television signals have been made. In the early days of television, signals were transmitted and received through the use of antennas. Signal strength and quality, however, were often dependent upon the geography of the land between the transmitting antenna and the receiving antenna. Although such transmission methods are still in use today, the use of satellites to transmit television signals is becoming more prevalent. Because satellite transmitted signals are not hampered by hills, trees, mountains, etc., such signals typically offer the viewer more viewing options and improved picture quality. Thus, many companies have found offering satellite television services to be very profitable and, therefore, it is anticipated that more and more satellites will be placed in orbit in the years to come. As additional satellites are added, more precise antenna/satellite alignment methods and apparatuses will be required.

Modern digital satellite communication systems typically employ a ground-based transmitter that beams an uplink signal to a satellite positioned in geosynchronous orbit. The satellite relays the signal back to ground-based receivers. Such systems permit the household or business subscribing to the system to receive audio, data and video signals directly from the satellite by means of a relatively small directional receiver antenna. Such antennas are commonly affixed to the roof or wall of the subscriber's residence or are mounted to a tree or mast located in the subscriber's yard. A typical antenna constructed to receive satellite signals comprises a dish-shaped receiver that has a support arm protruding outward from the front surface of the dish. The support arm supports a low noise block amplifier with an integrated feed "LNBF". The dish collects and focuses the satellite signal onto the LNBF, which is connected, via cable, to the subscriber's television.

To obtain an optimum signal, the antenna must be installed such that the centerline axis of the dish, also known as the "bore site" or "pointing axis", is accurately aligned with the satellite. To align an antenna with a particular satellite, the installer must be provided with accurate positioning information for that particular satellite. For example, the installer must know the proper azimuth and elevation settings for the antenna. The azimuth setting is the compass direction that the antenna should be pointed relative to magnetic north. The elevation setting is the angle between the Earth and the satellite above the horizon. Many companies provide installers with alignment information that is specific to the geographical area in which the antenna is to be installed. Also, as the satellite orbits the earth, it may be so oriented such that it sends a signal that is somewhat skewed. To obtain an optimum signal, the antenna must also be adjustable to compensate for a skewed satellite orientation.

The ability to quickly and accurately align the centerline axis of antenna with a satellite is somewhat dependent upon the type of mounting arrangement employed to support the antenna. Prior antenna mounting arrangements typically comprise a mounting bracket that is directly affixed to the rear surface of the dish. The mounting bracket is then attached to a vertically oriented mast that is buried in the earth, mounted to a tree, or mounted to a portion of the subscriber's residence or place of business. The mast is installed such that it is plumb (i.e., relatively perpendicular to the horizon). Thereafter, the installer must orient the antenna to the proper azimuth and elevation. These adjustments are typically made at the mounting bracket. Prior mounting brackets commonly employ a collection of bolts that must first be loosened to permit the antenna to be adjusted in one of the desired directions. After the installer initially positions the antenna in the desired position, the locking bolts for that portion of the bracket are tightened and other bolts are loosened to permit the second adjustment to be made. It will be appreciated that the process of tightening the locking bolts can actually cause the antenna to move out of its optimum position which can deteriorate the quality of the signal or, in extreme situations, require the installer to re-loosen the bolts and begin the alignment process over again. Furthermore, such mounting apparatuses cannot accommodate relatively fine adjustments to the antenna. In addition, because such crude bracket arrangements are attached directly to the rear of the dish, they can detract from the dish's aesthetic appearance.

One method that has been employed in the past for indicating when the antenna has been positioned at a proper orientation is the use of an inclinometer and a compass that is manually supported by the installer under the antenna's support arm. When using this approach however, the installer often has difficulty rotating the dish to the proper azimuth and elevating the dish to the proper elevation so that the antenna will be properly aligned and then retaining the antenna in that position while the appropriate bolts and screws have been tightened. The device disclosed in U.S. Pat. No. 5,977,922 purports to solve that problem by affixing a device to the support arm that includes a compass and an inclinometer.

Another method that has been used in the past to align the antenna with a satellite involves the use of a "set top" box that is placed on or adjacent to the television to which the antenna is attached. A cable is connected between the set top box and the antenna. The installer initially points the antenna in the general direction of the satellite, and then fine-tunes the alignment by using a signal strength meter displayed on the television screen by the set top box. The antenna is adjusted until the onscreen meter indicates that signal strength and quality have been maximized. In addition to the onscreen display meter, many set top boxes emit a repeating tone. As the quality of the signal improves, the frequency of the tones increases. Because the antenna is located outside of the building in which the television is located, such installation method typically requires two individuals to properly align the antenna. One installer positions the antenna while the other installer monitors the onscreen meter and the emitted tones. One individual can also employ this method, but that person typically must make multiple trips between the antenna and the television until the antenna is properly positioned. Thus, such alignment methods are costly and time consuming.

In an effort to improve upon this shortcoming, some satellite antennas have been provided with a light emitting diode ("LED") that operates from feedback signals fed to the antenna by the set top box through the link cable. The LED flashes to inform the installer that the antenna has been properly positioned. It has been noted, however, that the user is often unable to discern small changes in the flash rate of the LED as antenna is positioned. Thus, such approach may result in antenna being positioned in an orientation that results in less than optimum signal quality. U.S. Pat. No. 5,903,237 discloses a microprocessor-operated antenna pointing aid that purports to solve the problems associated with using an LED indicator to properly orient the antenna.

Such prior antenna mounting devices and methods do not offer a relatively high amount of alignment precision. Furthermore, they typically require two or more installers to complete the installation and alignment procedures. As additional satellites are sent into space, the precision at which an antenna is aligned with a particular satellite becomes more important to ensure that the antenna is receiving the proper satellite signal and that the quality of that signal has been optimized. With closely spaced satellites, installers may, if not careful, find they have aligned and peaked the antenna to the wrong satellite if they rely solely on signal strength meters. Only after evaluation with a set top box or other identifier might they determine that the signal is incorrect and further alignment corrections are required.

Thus, there is a need for a portable antenna alignment tool that offers the precision of a set top box, yet can be used by a single installer at the antenna installation.

Yet another need exists for a portable tool that has the above-mentioned characteristics that is rugged and weatherproof.

Another need exists for a tool having the above-mentioned attributes that is equipped with a strap and/or belt hook for portability purposes.

Still another need exists for a tool with the above-mentioned attributes that can generate an audio signal indicative of the antenna's alignment with a satellite.

Another need exists for a tool with the above-mentioned attributes that is equipped with an audio port to enable the installer to employ a headset for monitoring the audio signal generated by the tool that is indicative of the antenna's alignment with a satellite.

Yet another need exists for an antenna alignment tool that can be used to precisely align an antenna with a particular satellite that may be spaced, for example, at two degrees with respect to other adjacent satellites.

Another need exists for a portable antenna alignment device that is equipped with a meter for providing a visual indication of the alignment accuracy of an antenna and a satellite.

Still another need exists for an antenna installation method that can be quickly and efficiently employed by a single installer to precisely orient an antenna with a particular satellite without having to make several trips between the antenna and a television set to which its is coupled.

SUMMARY OF THE INVENTION

In accordance with one form of the present invention, there is provided a device for assessing a degree of alignment of an antenna with a satellite. In one embodiment, the device includes a portable housing and a CPU that is supported within the housing and coupled to a power supply. The device includes a connector for electrically coupling the CPU to an antenna junction box for receiving an RF signal therefrom. The device further includes signal-generating means supported within the housing and coupled to the CPU for generating a signal that is indicative of the degree of alignment between the antenna and the satellite.

Another embodiment of the invention comprises a device for assessing a degree of alignment of an antenna with a satellite. The device includes a handheld housing and a signal assessment means that is supported in the handheld housing. The signal assessment means is attachable to the antenna for receiving a signal therefrom that is indicative of the degree of alignment between the antenna and the satellite. The device also includes an indicator means coupled to the signal assessment means for providing at least one indicator indicating the degree of alignment between the antenna and the satellite.

Yet another embodiment of the subject invention comprises a device for assessing a degree of alignment of an antenna with a satellite. The device includes a handheld housing and a CPU that is supported within the handheld housing. The CPU is coupled to a power supply. A satellite communications frequency tuner is supported within the handheld housing and communicates with the CPU. A demodulator is supported within the handheld housing and communicates with the tuner. The demodulator receives a data stream from the tuner and extracts a bitstream therefrom. The bitstream is then communicated to the CPU. A display is supported on the handheld housing and communicates with the CPU for receiving display signals therefrom. The display provides visual indication of the degree of alignment between the antenna and the satellite. The device further includes a converter means for converting a digital audio signal generated by the CPU as a result of the CPU's receipt of the bitstream into an analog signal. The device also includes a speaker means for receiving the analog signal from the converter means and generating a corresponding audio signal.

It is a feature of the present invention to provide a portable antenna alignment tool that may be employed by an individual installer to precisely align an antenna with a particular satellite.

It is another feature of the present invention to provide a method of aligning antenna with a satellite that can be quickly and efficiently employed by a single installer.

Accordingly, the present invention provides solutions to the shortcomings of prior apparatuses and methods for orienting antennas for receiving satellite signals. Those of ordinary skill in the art will readily appreciate, however, that these and other details, features and advantages will become further apparent as the following detailed description of the embodiments proceeds.

BRIEF DESCRIPTION OF THE DRAWINGS

In the accompanying Figures, there are shown present embodiments of the invention wherein like reference numerals are employed to designate like parts and wherein.

DETAILED DESCRIPTION OF THE EMBODIMENTS OF THE INVENTION

Figure 1:
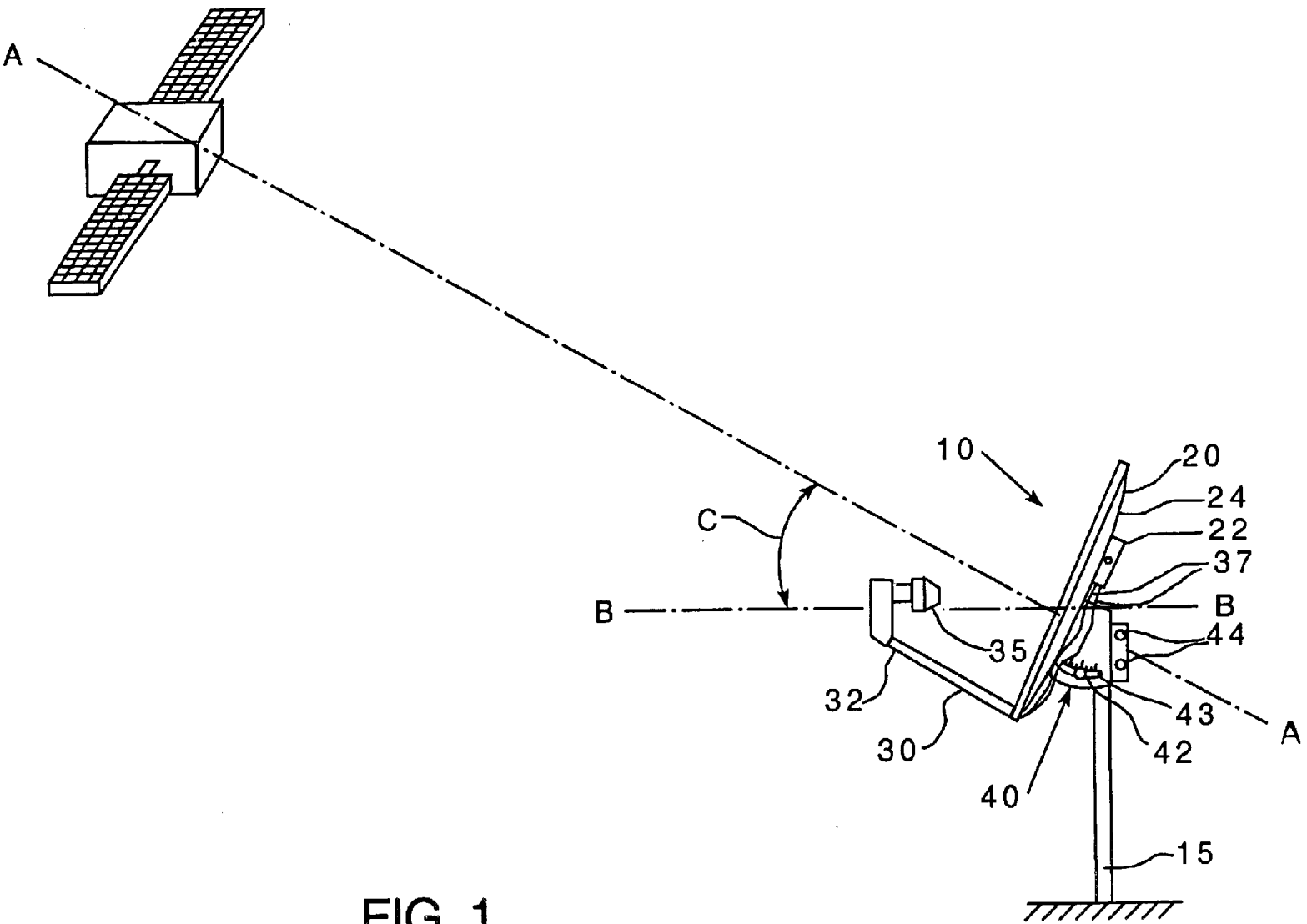
FIG. 1 is a graphical representation of a conventional antenna oriented to receive a signal from a satellite.

Referring now to the drawings for the purposes of illustrating embodiments of the invention only and not for the purposes of limiting the same, FIG. 1 illustrates a conventional antenna 10 that is mounted to a vertically extending mast 15 for receiving audio and video signals from a satellite 14 in geosynchronous orbit around the earth. The antenna 10 includes parabolic dish 20 and an arm assembly 30 that includes a forwardly extending portion 32 that supports a frequency converter 35 for collecting focused signals from the dish 20. Such frequency converters are known in the art and, therefore, the manufacture and operation of frequency converter 35 will not be discussed herein. The frequency converter 35 is electrically coupled to a junction box 22 on a rear surface 24 of dish 20 by cables 37. A mounting bracket 40 is affixed to the rear surface 24 of the dish 20 and serves to affix the dish 20 to the mast 15.

Antenna 10 must be properly positioned to receive the above-mentioned signals transmitted by the satellite 14 to provide optimal image and audible responses. This positioning process involves accurately aligning the antenna's centerline axis A—A, with the satellite's output signal. "Elevation", "azimuth" and "skew" adjustments are commonly required to accomplish this task. As shown in FIG. 1, elevation refers to the angle between the centerline axis A—A of the antenna relative to the horizon (represented by line B—B), generally designated as angle "C". In the antenna embodiment depicted in FIG. 1, the antenna's elevation is adjusted by loosening the elevation adjustment bolt 42 and pivoting the antenna dish 20 to the desired elevation. Thereafter, the elevation adjustment bolt 42 is tightened to retain the antenna dish 20 in that orientation. To assist the installer in determining the proper elevation setting, a plurality of reference marks 43 are commonly provided on the mounting bracket. See FIG. 1.

Figure 2:
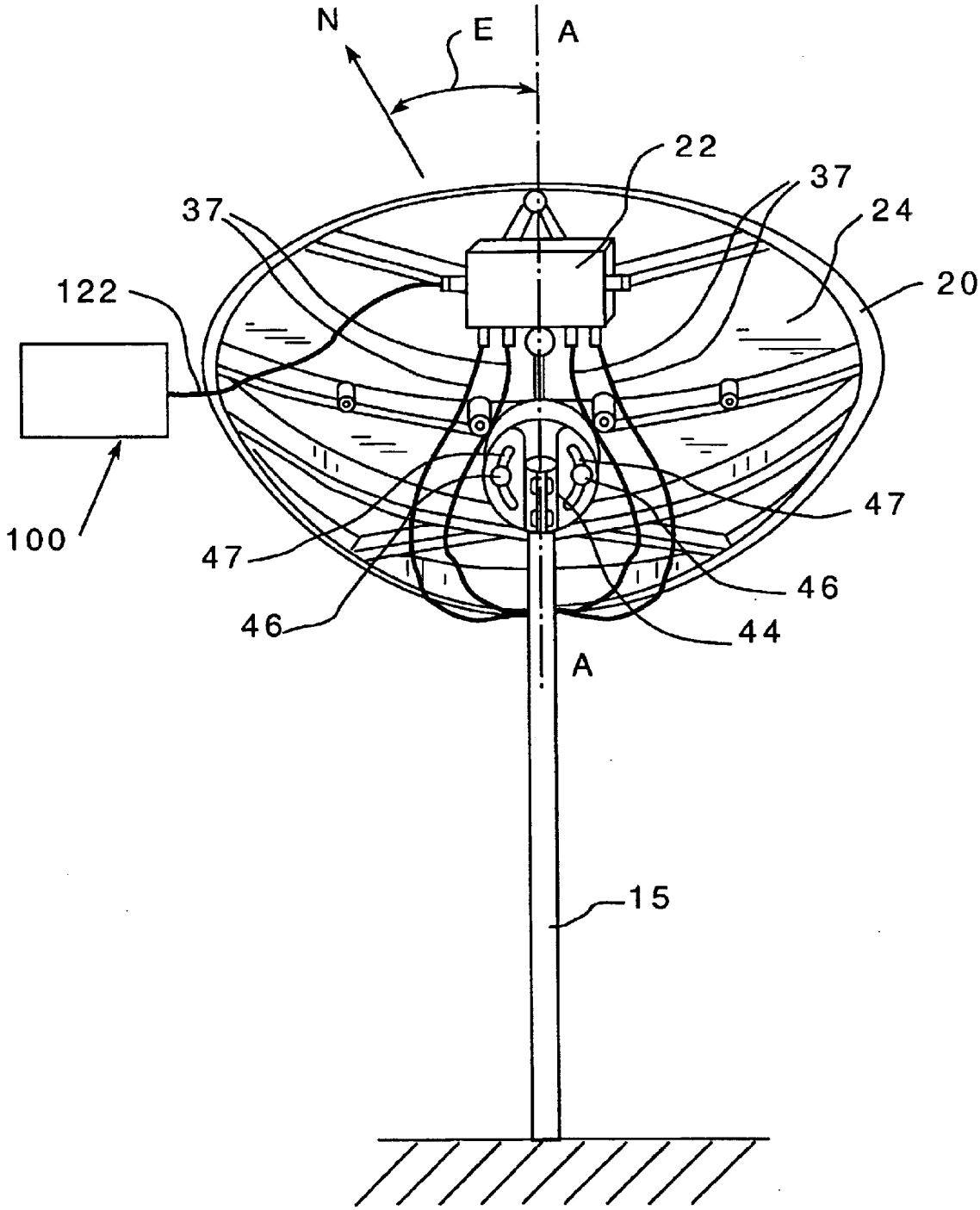
FIG. 2 is a rear view of the conventional antenna depicted in FIG. 1 with an antenna alignment tool of the present invention electrically coupled thereto.

As shown in FIG. 2, "azimuth" refers to the angle of axis A—A relative to the direction of true north in a horizontal plane. That angle is generally designated as angle "E" in FIG. 2. To adjust the azimuth of the antenna 10, the mounting bracket assembly 40 is equipped with azimuth locking members in the form of azimuth adjustment bolts 44. Azimuth adjustment bolts 44 are loosened and the antenna dish 20 is pivoted about the mast 15 until the desired azimuth orientation has been achieved. The azimuth adjustment bolts 44 are then retightened.

A pair of skew bolts 46 extend through arcuate slots 47 in the mounting bracket 40 and enable the dish 20 to be adjusted for skewing of the satellite signal. To adjust the dish 20 for skew, the bolts 46 are loosened and the dish 20 is pivoted in the desired direction. Thereafter, the bolts 46 are retightened. See FIG. 2.

When initially installing the antenna 10, the mounting mast 15 is preferably installed such that it is "plumb". Various methods have been developed for ensuring that the mast 15 is plumb. For example, a conventional level or plumb bob may be used. Those of ordinary skill in the art will also appreciate that the mounting mast may be affixed to a building or other structure, a tree, etc. After the mast 15 has been installed, the mounting bracket 40 is affixed to the mast 15. The antenna may then be positioned in a preliminary orientation wherein it is set at an initial elevation, azimuth and skew orientation. However, to obtain an optimal signal from the satellite, the portable satellite installation tool 100 of the present invention may be used.

Figure 3:
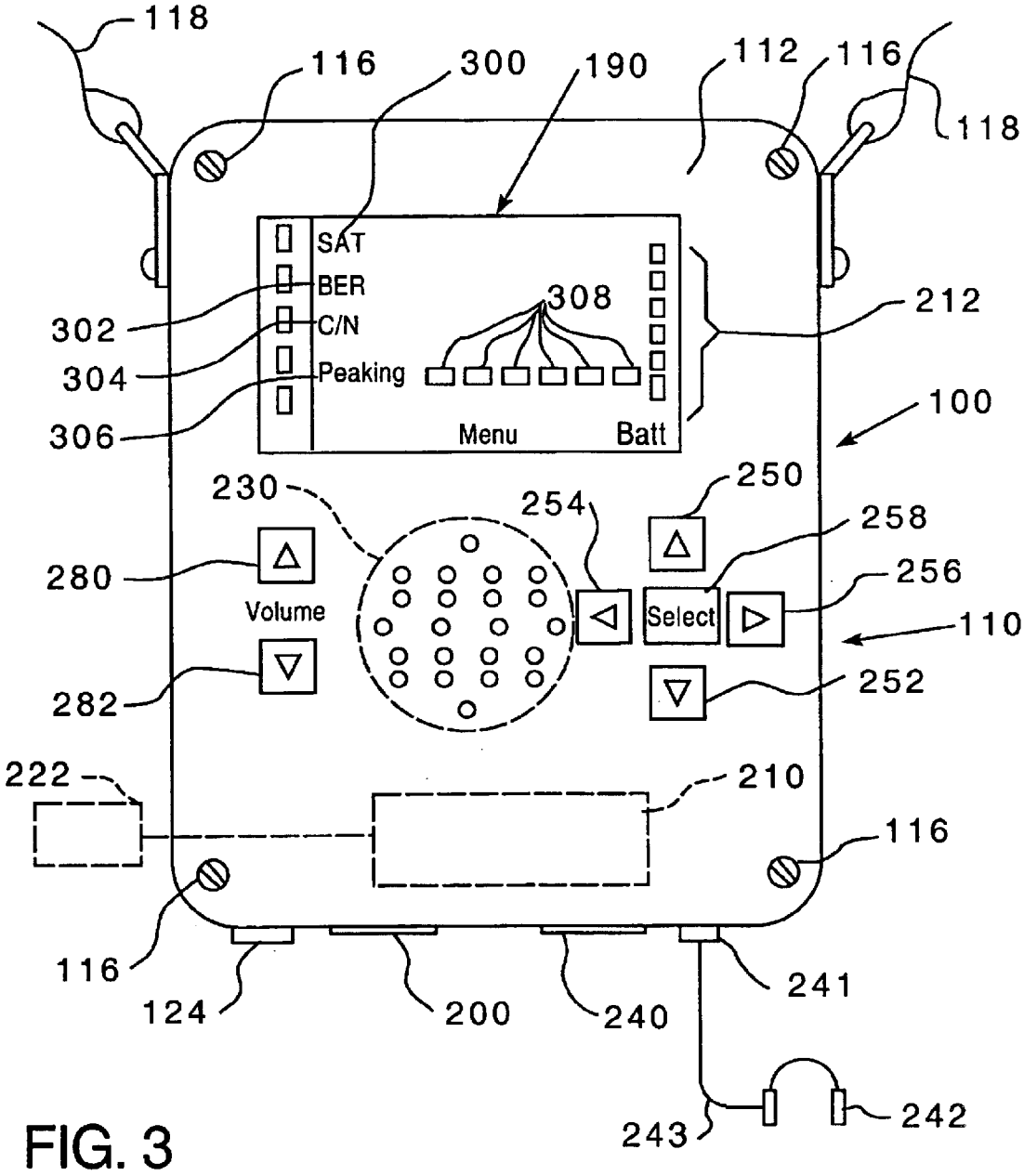
FIG. 3 is a front view of one embodiment of the antenna alignment tool of the present invention.
Figure 4:
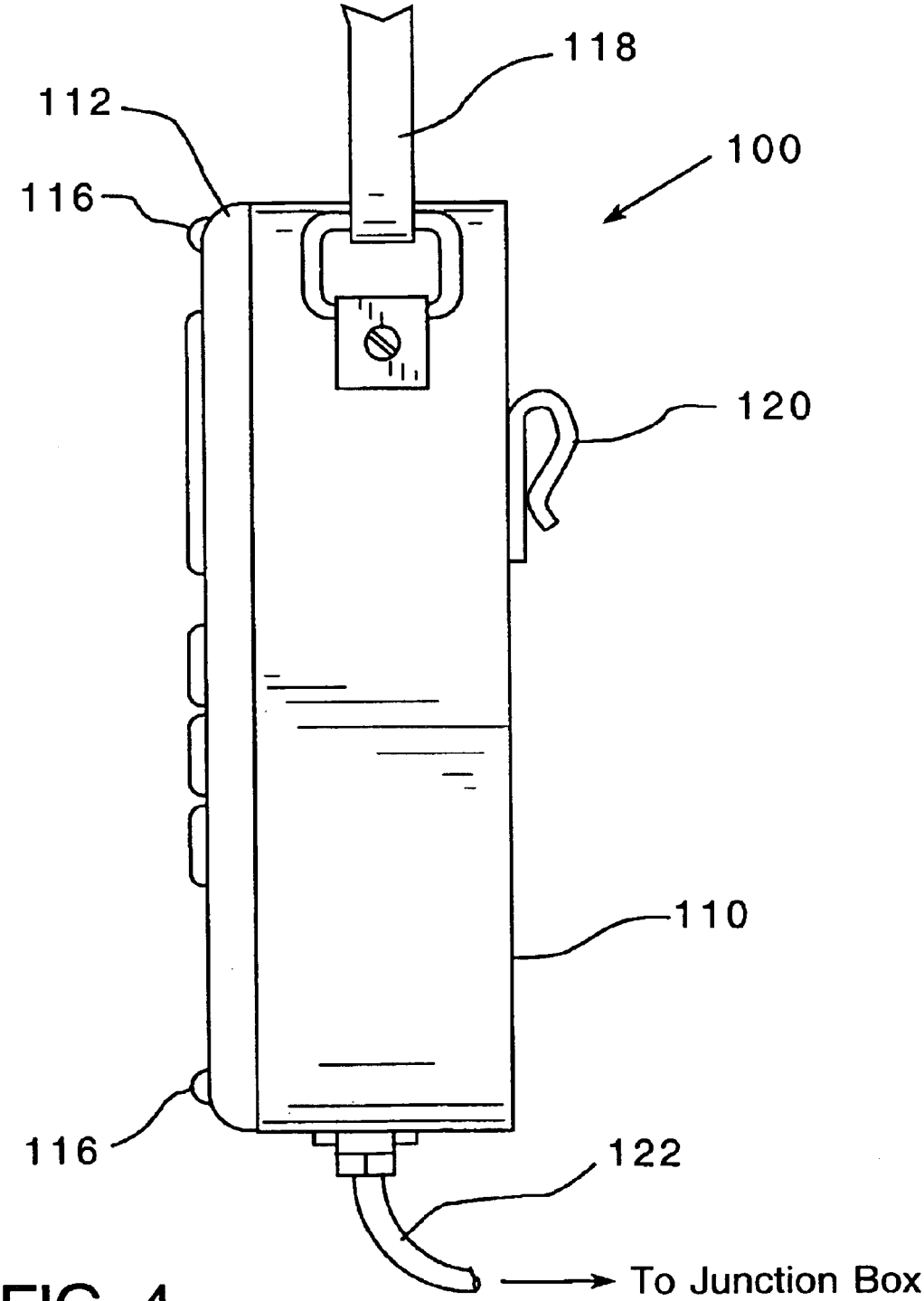
FIG. 4 is an end view of the antenna alignment tool depicted in FIG. 3.
Figure 5:
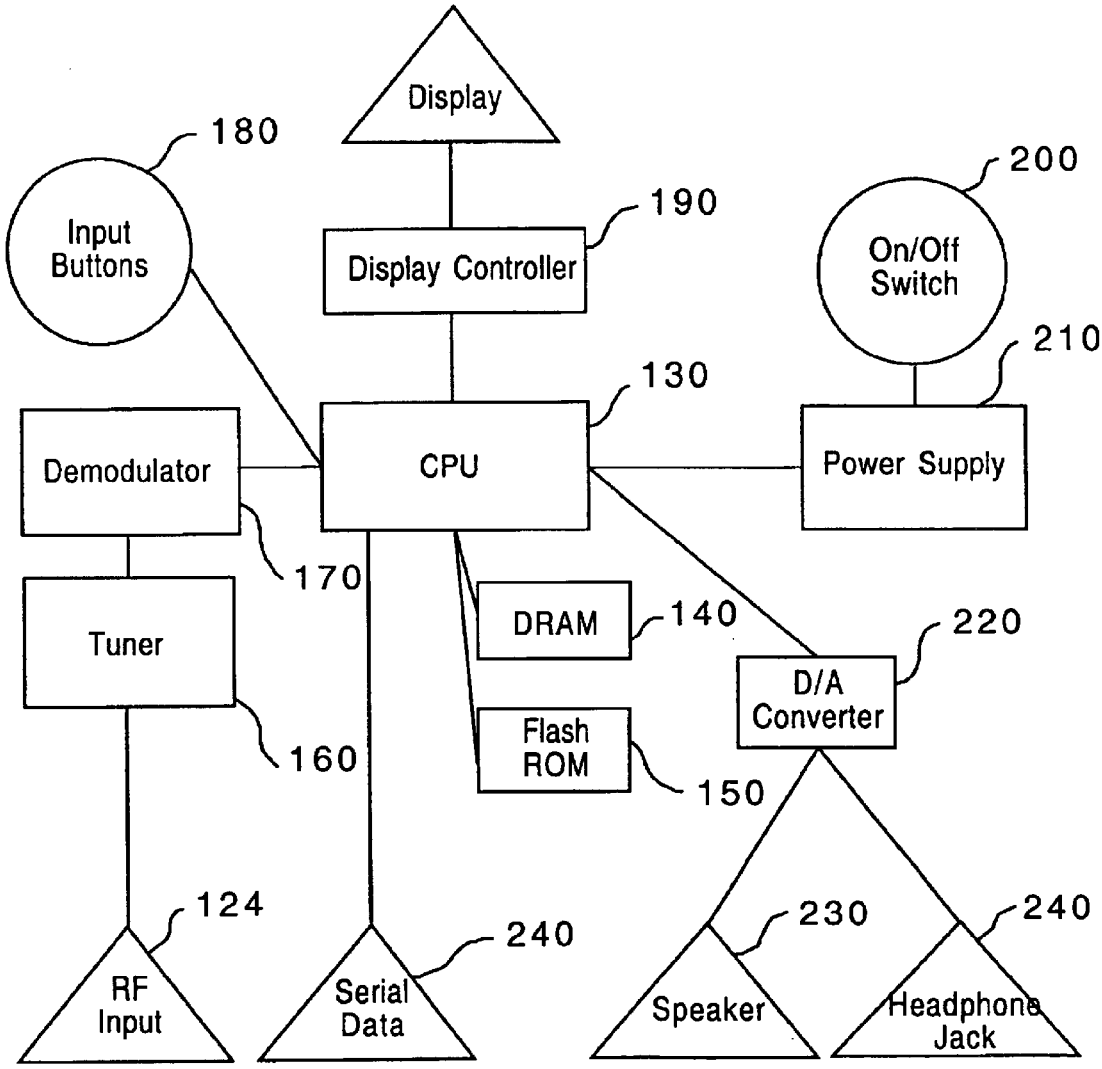
FIG. 5 is a schematic of the major components of one embodiment of the antenna alignment tool of the present invention.

As can be seen in FIGS. 3–5, one embodiment of the portable satellite installation tool 100 includes a housing 110 that has a removable cover 112 attached thereto by, for example, screws 116 or other removable fastener arrangements. Housing 110 may be fabricated from plastic, aluminum, or other suitable materials such that housing 10 is impact resistant. A gasket or O-ring seal (not shown) may be employed to establish a watertight seal between the removable cover 112 and the housing 110 to prevent infiltration of moisture into the housing 110. Those of ordinary skill in the art will appreciate that the housing 110 of this embodiment is portable and may be equipped with a support strap 118 for transport by installation personnel. In one embodiment, the housing 110 is sized such that it may be supported in the installer's hand. For example, such housing may be 4 inches wide, six inches high, and one inch thick. However, the housing may be provided in a myriad of other shapes and sizes. In addition, or in the alternative, the housing 110 may be equipped with a hanger 120 that enables the installer to hook the tool 100 to a belt or onto the antenna or ladder, etc. during installation. As can be seen in FIG. 2, the tool 100 is electronically coupled to the junction box 22 by a coaxial cable 122 that removably plugs into a conventional RF input F-connector 124. See FIG. 3. As used herein, the term "portable" means that the tool may be transported, supported and manipulated by a single individual without the assistance of other individuals or devices.

As can be seen in FIGS. 3–5, one embodiment of the tool 100 may include the following "major" components: CPU 130, DRAM memory 140, FLASH ROM memory 150, a tuner 160, a demodulator 170, input buttons 180, a display controller 190, an on/off switch 200, a power supply 210, a D/A converter 220, a speaker 230, a headphone jack 241, serial data port 240 and an RF input connector 124 all housed within the housing 110. The tool 100 also includes other minor components as necessary to implement electronic devices (resistors, capacitors, minor processing chips and circuits, etc.) that are within the skill of a person of ordinary skill in the art and which are not material to the understanding of the construction and operation of the tool 100. It will be appreciated that many of the minor and major components mentioned above could conceivably be incorporated into single-chip solutions or otherwise integrated into pre-integrated packages for cost reduction and ease of design and manufacturing. Minor differences in combinations and packaging would likely have no effect on operations nor upon the implementation of the processes of the various embodiments of the subject invention.

In this embodiment, the CPU 130: (i) controls the overall behavior of the tool 100 and loads and runs the software applications stored in the FLASHROM memory 150; (ii) temporarily stores information and values in the DRAM memory 140; (iii) accepts input messages and data from input devices such as a laptop computer connected by serial cable to serial data port 240 and user-input components such as the input buttons 180 and on/off switch 200; and (iv) processes the bitstream from the demodulator 170 to determine if a known satellite signal is being received and assess the quality of the signal received which is indicative of the degree of alignment between the satellite and the antenna. Also, based upon calculations performed and the current operating mode, the CPU 130 generates output text in the display 190, and an audio signal for the speaker 230 or headphones 242 that are coupled to the tool 100 via the headphone speaker jack 241 and cable 243.

Also in this embodiment, the DRAM memory functions as non-permanent storage for information and values used in computation by the CPU. Information stored in the DRAM may be lost when the power is removed from the tool 100.

The FLASH ROM 150 in this embodiment facilitates permanent and persistent storage for applications and setup/configuration information. Information stored in the FLASHROM 150 is not lost when the power is removed from the tool 100. Alternatively, non-volatile RAM (NVRAM) (not shown) could be used with FLASH ROM 150 if desired.

The tuner 160 tunes, at the request of the CPU 130, to a specific satellite communication frequency and passes the resulting data stream, if any, onto the demodulator 170. The demodulator 170 extracts a standard bitstream (for processing by the CPU 130) from an incoming satellite communication signal carrier (selected and provided by the tuner 160).

The audio D/A converter 220 converts a digital signal from the CPU 130 into an analog representation for audio output by the speaker 230 or the headphone jack 241. A switch (not shown) may be included that directs the signal to only one of the output devices. In such arrangement, when the headphone jack 241 is in use, the speaker 230 is disabled. Likewise, if no headphones 242 are connected to the headphone jack 241, the signal is only provided to the speaker 230 and no signal is directed to the headphone jack 241.

This embodiment of the tool 100 also includes a power supply 210 which could comprise a jack (not shown) for supplying A/C power to the tool components from a source of A/C power (diagrammatically represented as 222) or the tool 100 could be powered by a battery source that is supported within the housing 110. The specific selection of a battery source would be based on the manufacturer and user requirements for desired continuous hours of operation, display type chosen, power consumption of selected processors and components, supply power to the LNB, and whether the battery is modular swappable or fully integrated into the tool 100. An integrated battery would likely require integrating recharging circuitry. Recharging methods could include, but would not be limited to, AC power, or power supplied through an automobile 12V DC adapter, etc. Also in this embodiment, a power level monitor 212 is employed to provide the installer with an indication of the relative or absolute battery power remaining.

The on/off switch 200 is operable by the installer and may be somewhat recessed within the housing 110 to prevent accidental actuation. Further, by placing the on/off switch 200 in the bottom of the housing 110, the switch will be somewhat shielded to prevent the infiltration of snow, rain etc. into the housing 110. The input buttons are also operable by the installer and may comprise a separate "up" button 250, a separate "down" button 252, a separate "left" button 254, a separate "right" button 256 and an "enter/select" button 258. See FIG. 3. Each button provides an electrical signal to the CPU when depressed. In this embodiment, the buttons (250, 252, 254, 256, 258) may comprise conventional membrane-style buttons that are slightly raised above the outer surface of the housing cover 112 when installed therein and are substantially waterproof.

The display controller 190 accepts the desired text and/or graphic information to be displayed from the CPU 130 and controls the appropriate display component (LED panel, LCD panel, etc.) to display the desired information to the installer.

The serial data port 240 permits the tool 100 to be connected to a separate computer (not shown) to enable the install device software FLASH ROM memory to be upgraded or replaced as desired. This data port could comprise a 9-pin D-shell or alternatively USB, RSB232 or others.

In use, the speaker 230 or headphones 242 receive audio tones from the CPU 130 to assist the installer in the alignment process. Many different choices of audio tones could be made to provide indications regarding the satellite being received, BER and/or C/N values, etc. Those of ordinary skill in the art will appreciate that the BER value is the Bit Error Rate and indicates the number of symbol errors per sample size and that the C/N value is the Carrier to Noise Ratio, and indicates that difference between the amplitude of the carrier signal and the noise floor. An audio signal can be generated which varies in pitch/tone, periodicity of discreet tones, multi-tones, etc. To control the volume of the audio signal, the tool 100 may include volume control buttons 280, 282. See FIG. 3. One embodiment of the subject invention operates as follows: Different audio tones are generated based on the nature of the current signal received through the RF input 124, the tuner 160, the demodulator 170 and the CPU 130. If the power switch 200 is off, no audio signal is generated. If no signal is received through the RF input 124, no audio signal is generated. If a signal is being received through the RF input 124, but it is not from the desired satellite, a low-to-mid frequency tone (perhaps 220 hz) may be produced for a desired period of, for example, 0.25 seconds and repeated at desired intervals such as every two seconds. If a signal is received from the desired satellite through the input port 124, a mid-frequency tone (perhaps 440 hz) may be produced and repeated based on the BER and C/N values calculated by the CPU. The tone may start out at one 0.25 sec duration note repeated at variable speeds starting one every two seconds and increasing to a continuous tone as the alignment is improved resulting in improved BER, C/N being calculated. Thus, in this embodiment, a continuous tone would indicate that the best alignment has been achieved.

In addition, in this embodiment, a visual indication of the degree of alignment and signal quality is presented by the display 190. The tool 100 may employ a full multi-line text display or a simplified series of LED "dots" as desired. For example, a "fill" text version of the tool might display one or more of the following: (i) a display 300 indicating the identity of the satellite or display a "?" if the satellite has not been identified, (ii) a display 302 indicating the current measured BER value for the signal being received, (iii) a display 304 indicating the current C/N or other value for the signal being received, and/or a multi-segmented bar graph 306 indicating overall quality of signal. "Quality of the signal" as used herein is the measurement of each performance parameter (BER, C/N, Signal Level, EbNo, EsNo). It is conceivable that the user could develop an equation to apply relative merit to each and which results in an appropriate display message and which can be optimized for the particular components employed. The number of segments 308 displayed would be proportional to the quality of the signal received. For example, the desired quality signal would display all segments. An unusable signal would display no segments. As the installer manipulates the antenna attempting to maximize performance, the audio and visual indicators representing signal strength/quality will change in real-time providing immediate feedback to the installer thereby allowing the installer to further adjust the alignment of the antenna.

Figure 6:
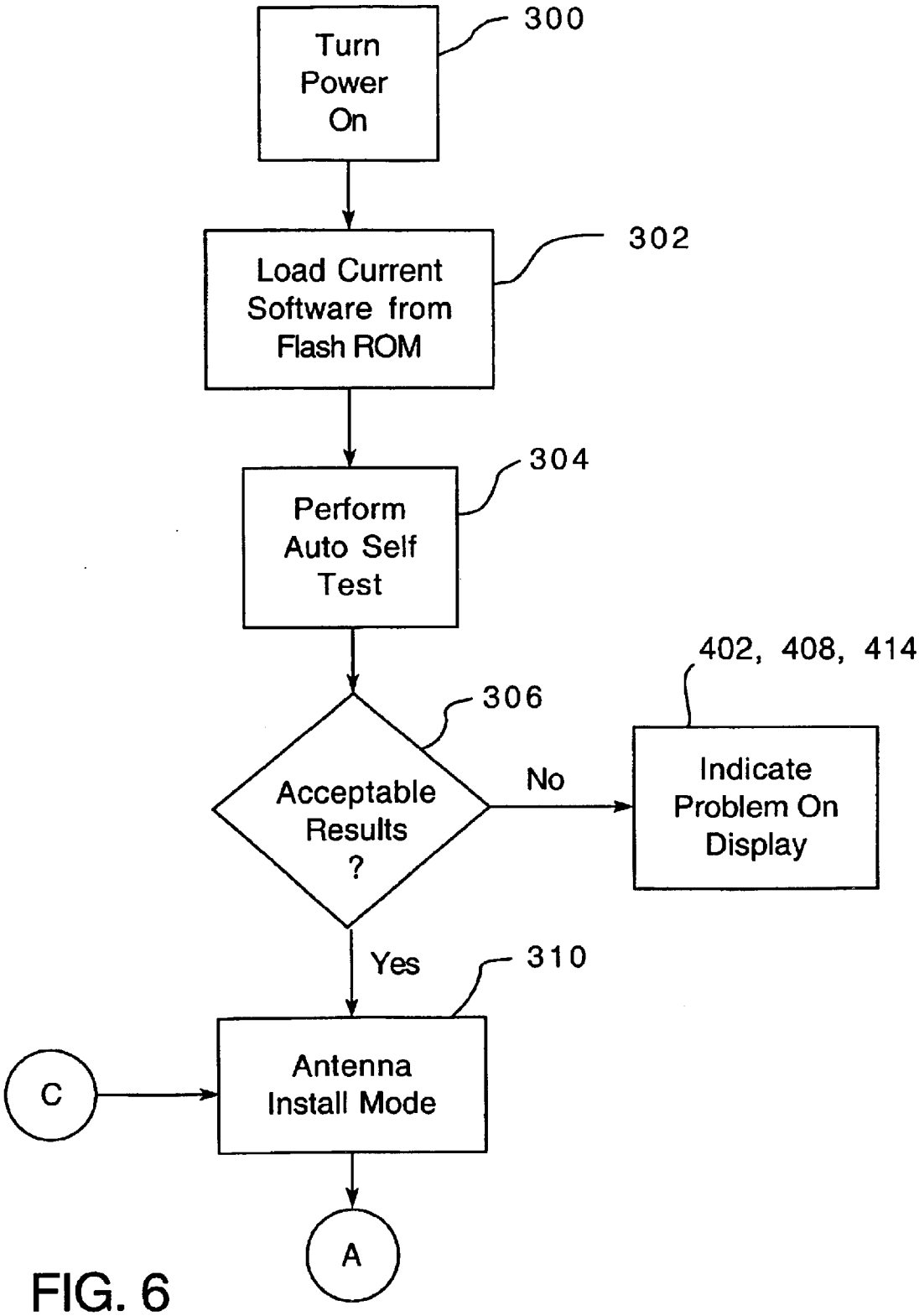
FIG. 6 is a flow chart of some of the steps performed by one software package that may be employed by one embodiment of the present invention.
Figure 6A:
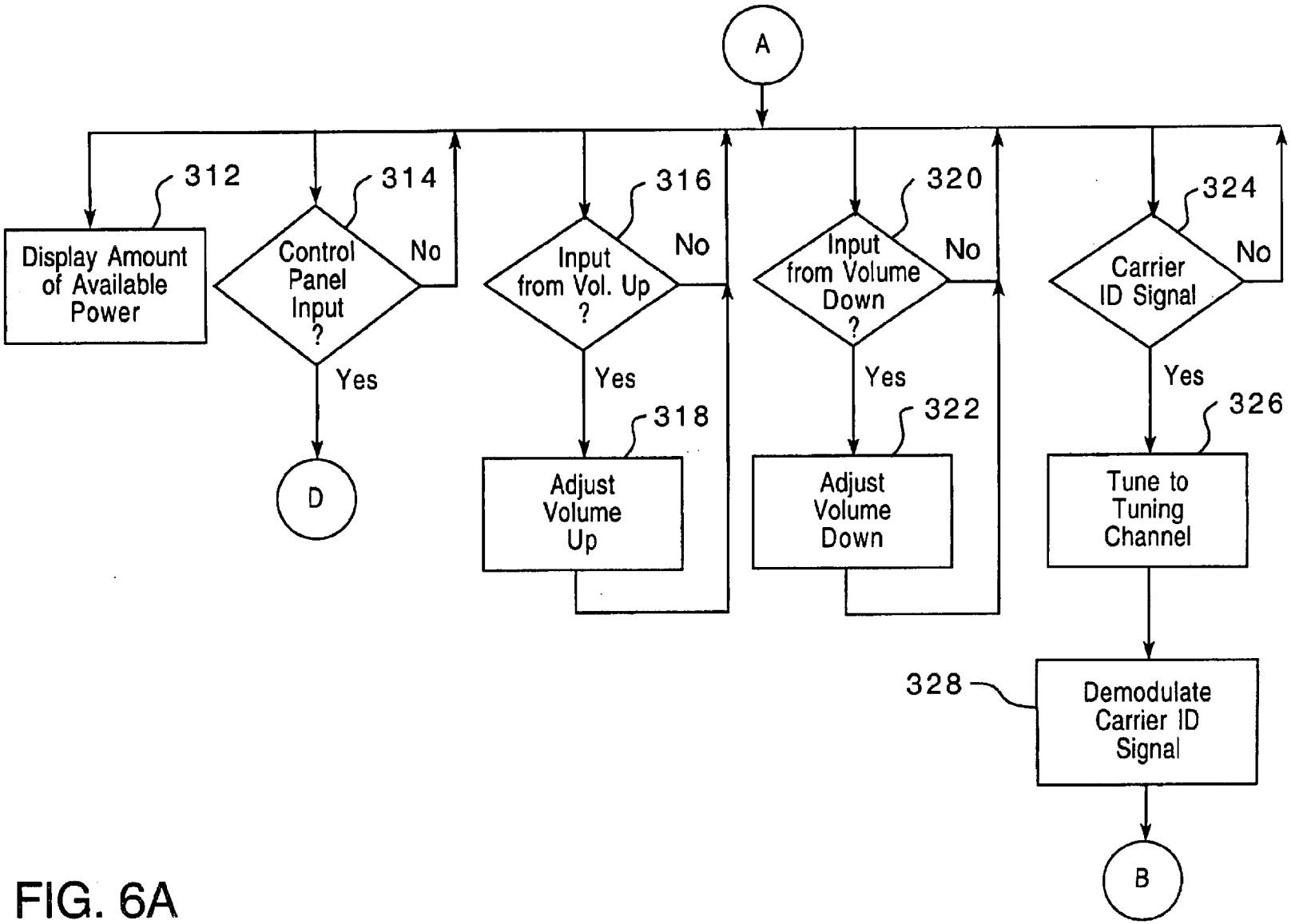
FIG. 6A is a flow chart of other steps performed by one software package that may be employed by one embodiment of the present invention.
Figure 6B:
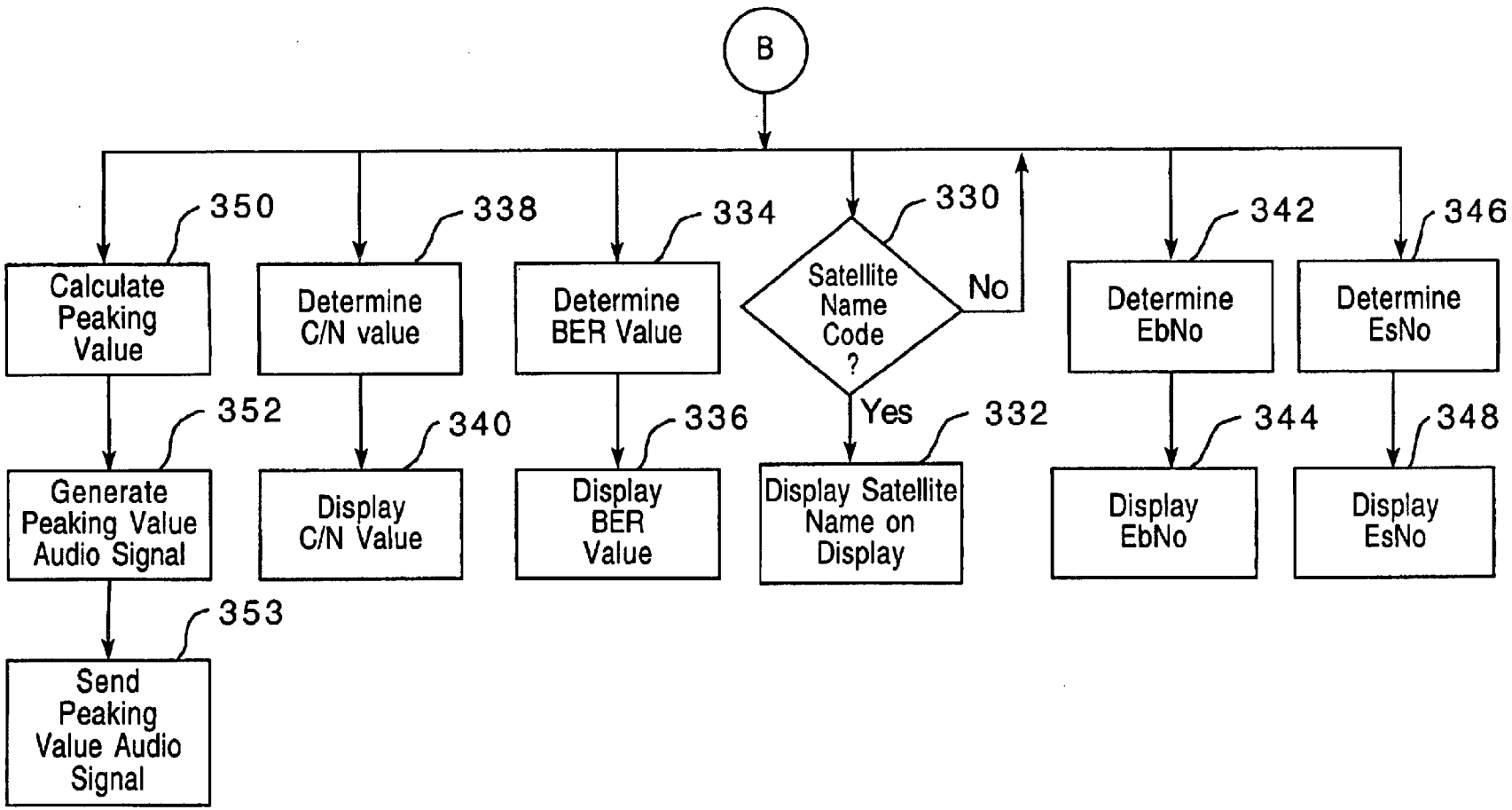
FIG. 6B is another flow chart of additional steps performed by one software package that may be employed by one embodiment of the present invention.

In one embodiment of the subject invention, the CPU 130 employs software that causes the tool 100 to operate in the manner described below and depicted in the flow chart of FIGS. 6–6D. The various functions of the tool 100 can be implemented in computer software code using, for example, Visual Basic, C, or C++ computer languages using, for example, object oriented techniques.

After the installer couples the tool 100 to the junction box 22 of the satellite dish/LNB combination and an external power source if necessary, the tool 100 is turned on through the on/off switch 200 (step 300). This action causes the software to be loaded into the CPU 130 from the FLASH ROM memory 150 (step 302). The CPU 130 then performs an auto self test (step 304) which comprises the internal performance integrity checks depicted in FIG. 6C. If the self test is successful, the CPU defaults to the antenna install mode (step 310). If a problem is discovered, it is indicated on the display 190 (steps 402, 408, 414).

When in the antenna install mode, the CPU 130 continuously displays the amount of available power for consumption on the display 190 (step 312). Also in the antenna install mode, the CPU 130 checks for control panel input (step 314). If there is control panel input, the CPU 130 then proceeds to the control panel input routine (step 360) which will be described below. The CPU 130 also checks to determine whether it has received input from the volume up button (step 316) and, if so, the volume is increased one increment at a time (step 318). Likewise, the CPU 130 checks to determine whether it has received input from the volume down button (step 320) and, if so, the volume is reduce one increment at a time (step 322). Also when in the antenna install mode, the CPU 130 continuously checks for a carrier ID signal from the RF input port (step 324). If a signal is received, the CPU 130 tunes to an appropriate tuning channel (step 326). The demodulator 170 then demodulates the carrier ID signal (step 328) and the CPU 130 examines the carrier ID signal and compares it with a collection of stored satellite name codes stored in the FLASH ROM (step 330). If the corresponding satellite name code is discovered, it is displayed on the display (step 332). The CPU 130 also determines the BER value (step 334) and displays the BER value on the display 190 (step 336). The CPU 130 also determines the C/N value (step 338) and displays it on the display 190 (step 340). The CPU 130 may also determine the "EbNo" value which is Energy Per Bit vs. Noise (step 342) and display it on the display 190 (step 344). The CPU 130 may also determine the "EsNo" value (step 346) which is Energy Per Symbol vs. Noise and display it on the display 190 (step 348). In step 350, the CPU 130 calculates the "peaking value" which is the percentage of optimal signal calculated by dividing measured value by optimal value and then generates a peaking value audio signal (step 352) and transmits the peaking value audio signal to the speaker and/or audio jack (step 353).

Figure 6C:
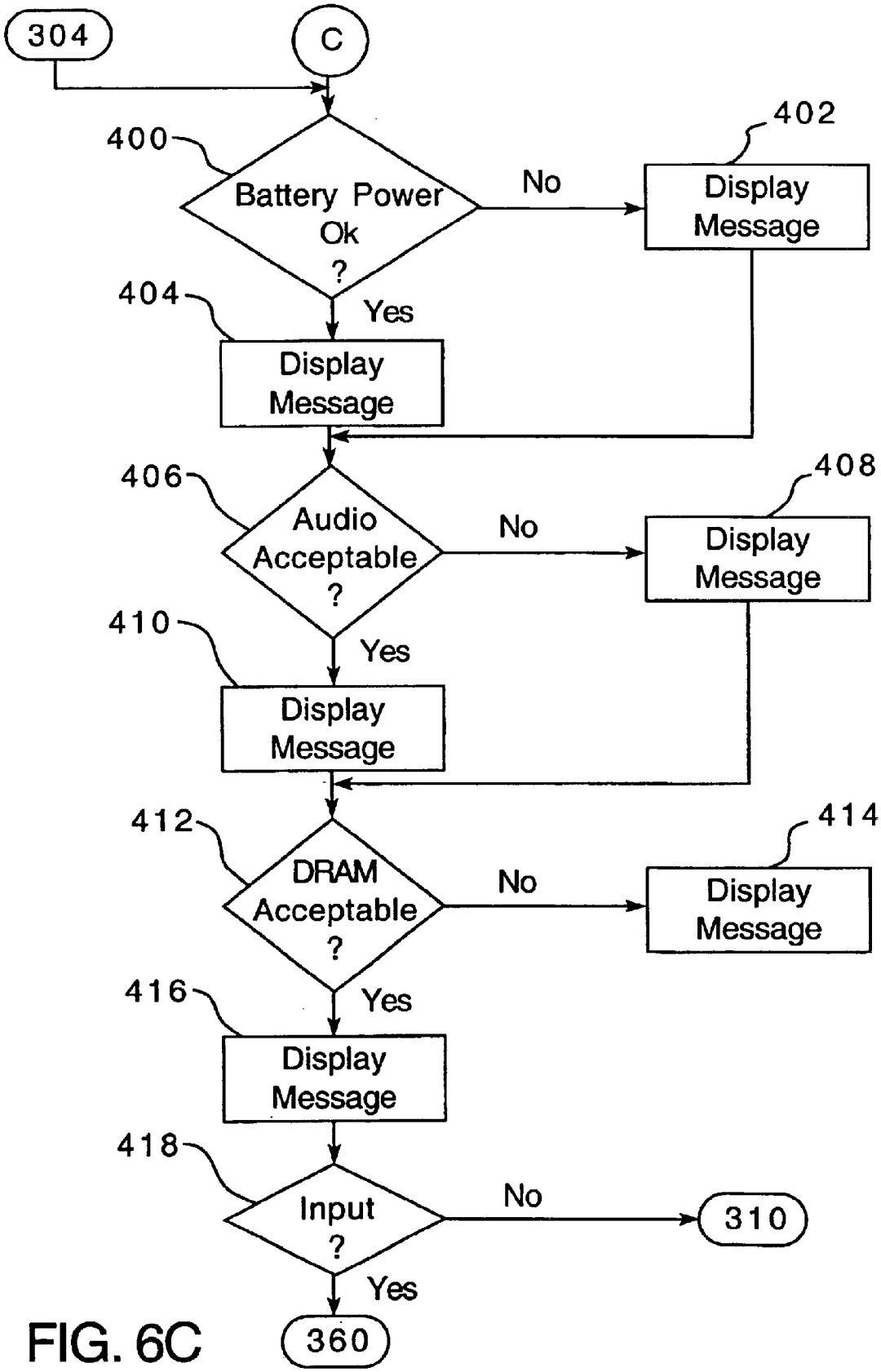
FIG. 6C is a flow chart of one embodiment of a self test routine of the present invention.
Figure 6D:
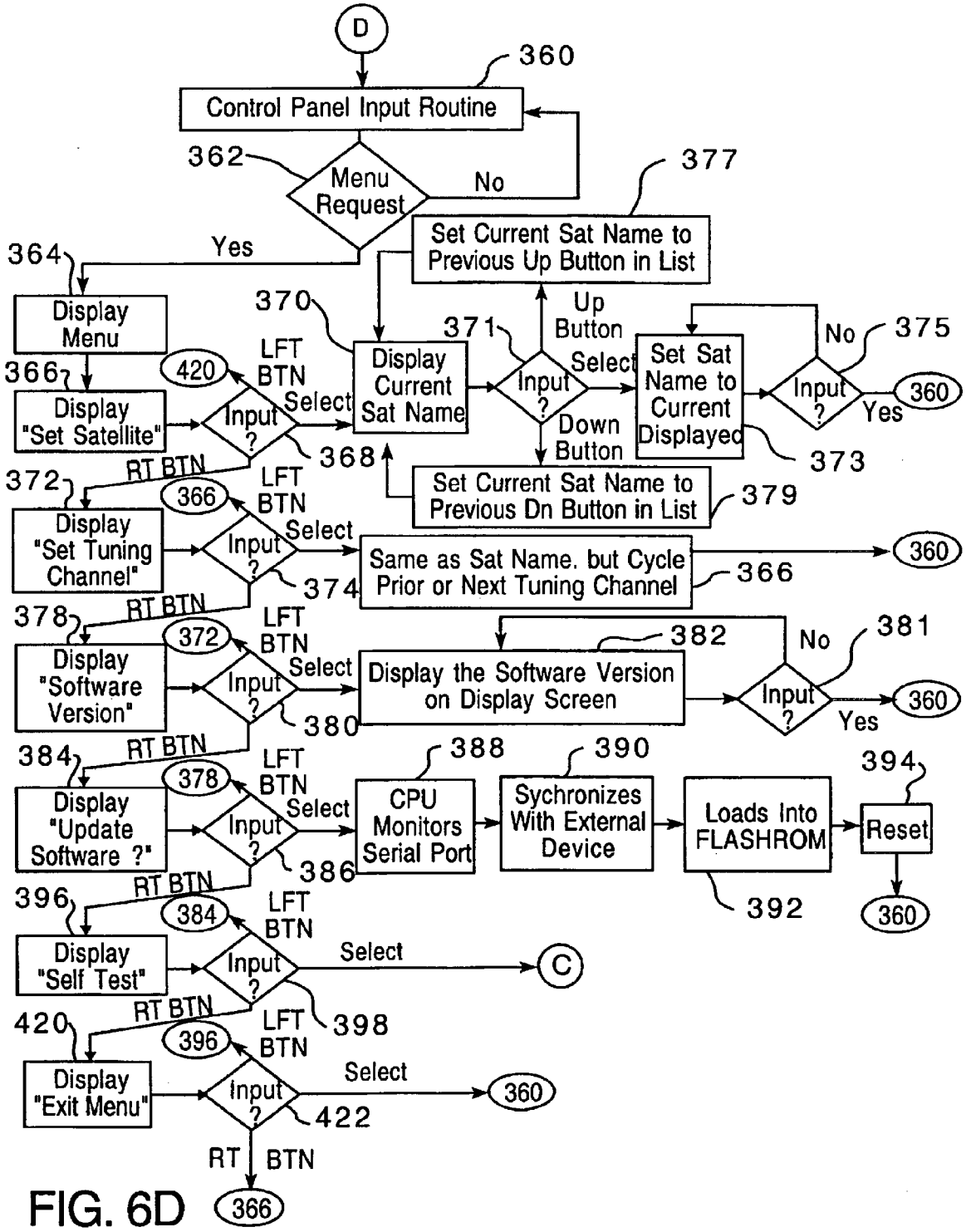
FIG. 6D is a flow chart of one embodiment of the control panel input routine of the present invention.

When in the control panel input routine (step 360) as shown in FIG. 6D, the CPU 130 checks to determine whether the menu has been requested (step 362). If so, the menu is displayed on the display 190 (step 364). In this embodiment, "Set Satellite" is displayed (step 366) and the CPU checks for input (step 368) entered by pressing the select button 258 to enter set satellite mode. When in the set satellite mode, the current satellite is displayed (step 370). After the current satellite is displayed on the display (step 370), the program enters the input mode (designated as step 371). When in the input mode, the user can simply select the currently displayed satellite by depressing the select button (step 373). After the satellite has been selected, the program can be returned to the control panel input mode (step 360) by pressing any button (step 375). If the user desires to move "up" through the list of available satellites, the up button is depressed (step 377) and the selected satellite is displayed on the display (step 370). If the user desires to move "down" through the list of available satellites, the down button is pressed (step 379) and the selected satellite is displayed on the display (step 370). After the desired satellite has been displayed, it is selected in the above-described manner.

Also displayed on display 190 is "Set Tuning Channel" (step 372) and the CPU 130 checks for input (step 374). If input has been entered into the CPU 130 by the up/down/select buttons as described above, it is displayed on the display 190 (step 366). The program then returns to the control panel input routine (step 360). By depressing the left button 254, the program returns to Display Set satellite mode (step 366). By depressing the right button 256, the program moves to the Display Software Version mode (step 378). When in the "Display Software Version" mode, the current software version is displayed on the display 190. The CPU 130 then checks for input (step 380) which may be entered by the select button. If select button input is detected, the software version currently employed is displayed on the display 190 (step 382). The program can be returned to the control panel input routine (step 360) by pressing any button (step 381). If the left button 254 is depressed, however, the program will return to the Set Tuning Channel mode (step 372). If the right button 256 is depressed, the program will progress to the Display Update Software mode (step 384) and "Update Software" is on the display 190. When in that mode, the CPU 130 checks for input (step 386) and if input is entered by pressing the select button, the CPU 130 monitors the serial port (step 388), synchronizes with an external device such as a laptop computer (step 390), loads software into FLASHROM (step 392), and resets the device 100 (step 394) and returns to control panel input routine (step 360). If the left button 254 is depressed, the program returns to the Display Software Version mode (step 378). If the right button 256 is depressed, the program progresses to the Display Self test mode (step 396) and displays "Self Test" on the display 190. When in the Display Self Test mode, the CPU 130 checks for input entered by pressing the select button (step 398). If input is detected, the CPU 130 performs a self test as shown in FIG. 6C. By depressing the left button 254, the program returns to the Display Update Software mode (step (384). If the right button is depressed, the program progresses to the Display Exit Menu mode (step 420).

As can be seen in FIG. 6C, when in the self test mode, the CPU 130 checks the battery power (step 400) and displays the appropriate messages (steps 402, 404). The CPU 130 also checks to determine whether the audio is acceptable (i.e., the tone generated indicates to the user whether the unit is in need of repair) (step 406) and displays the appropriate messages in steps (408, 410). The CPU 130 also checks to determine whether the DRAM memory is acceptable (i.e., by use of parity check or other suitable method (step 412) and displays the appropriate messages on the display 190 (steps 414, 416). The program can be returned to the control panel input routine (step 360) by pressing any button (step (418).

When in the Exit Menu mode, "Exit Menu" is displayed on the display 190 and the CPU 130 checks for input (step (422). By depressing the left button, the program is returned to the "Display Self Test mode" (step 396). If the right button is depressed, the program is returned to the "Display Satellite" mode (step 366). If the select button is depressed, the program returns to the control panel input routine (step 360).

Those of ordinary skill in the art will readily appreciate that such arrangement permits an individual installer to employ the installation device of the present invention while remaining at the antenna to make any necessary alignment adjustments. Because of its portable nature, only one installer is required to align an antenna with a satellite. This represents a vast savings in time and money that are normally required when utilizing a set top box that is attached to the television set to which the antenna is coupled. While the various embodiments disclosed herein are described for use with a satellite, those of ordinary skill in the art will readily appreciate that the various features and aspects of the present invention could conceivably used to align an antenna with other devices that transmit signals receivable by the antenna.

Thus, from the foregoing discussion, it is apparent that the present invention solves many of the problems encountered by prior antenna alignment devices and methods. In particular, various embodiments of the present invention are easy to install and use. The present invention enables one installer to quickly and efficiently install and align an antenna with a satellite. Various embodiments of the present invention enable the installer to align an antenna with a satellite with the precision offered by prior set top box arrangements without making several trips between the antenna and the television. Those of ordinary skill in the art will, of course, appreciate that various changes in the details, materials and arrangement of parts which have been herein described and illustrated in order to explain the nature of the invention may be made by the skilled artisan within the principle and scope of the invention as expressed in the appended claims.

What is claimed is:

1. A device for assessing a degree of alignment of an antenna with a satellite comprising:

a portable housing including a display;

a CPU located within the housing; and a signal generator in communication with said CPU for generating a signal that is indicative of the degree of alignment between the antenna and the satellite, said signal generator including a satellite communications frequency tuner communicating with said CPU and a demodulator communicating with said tuner, said demodulator receiving a data stream from said tuner and extracting a bitstream therefrom and communicating said bitstream to said CPU, wherein said CPU calculates a bit error rate (BER) value of the signal from said bitstream, calculates a carrier to noise (C/N) value of the signal from said bitstream, and calculates an overall quality of signal based on said BER value and said C/N value and said display visually indicates the BER value, the C/N value, and the overall quality of signal simultaneously.

2. The device of claim 1 wherein said signal generator comprises:

a converter for converting a digital audio signal generated by said CPU as a result of said bitstream into an analog signal; and a speaker for receiving said analog signal from said converter means and generating a corresponding audio signal.

3. The device of claim 2 further comprising:

an audio jack coupled to said converter; and headphones removably attachable to said audio jack.

4. The device of claim 1 wherein said display visually indicates the overall quality of signal as a bar graph.

5. The device of claim 4 wherein said display also displays information relating to satellite identity.

6. The device of claim 1 wherein said CPU is powered by a power supply selected from the group consisting of: a battery and a source of A/C power.

7. The device of claim 6 wherein said battery is removably supported in said housing.

8. The device of claim 6 wherein said battery is non-removably supported in said housing.

9. The device of claim 6 wherein said battery is rechargeable.

10. The device of claim 6 further comprising a power level monitor supported in said housing for providing a visual indication of power generated by said power supply that is available for consumption by said CPU.

11. The device of claim 1 wherein when said CPU is coupled to a junction box of an antenna, said power supply supplies power to a frequency converter of the antenna.

12. The device of claim 1 further comprising a support strap attached to said housing.

13. The device of claim 1 further comprising a support hook attached to said housing.

14. A device for assessing a degree of alignment of an antenna with a signal transmitting device, comprising:

a handheld housing including display means;

signal assessment means supported in said handheld housing and attachable to the antenna for receiving a signal therefrom that is indicative of the degree of alignment between the antenna and the signal transmitting device and for assessing the received signal by extracting a bitstream from the received signal, calculating a bit error rate (BER) value of the received signal from said bitstream, calculating a carrier to noise (C/N) value of the received signal from said bitstream, and calculating an overall quality of signal based on said BER value and said C/N value; and indicator means coupled to said signal assessment means for providing indicator signals indicating the degree of alignment between the antenna and the signal transmitting device, wherein said display means visually displays the BER value, the C/N value, and the overall quality of signal simultaneously in response to said indicator signals.

15. The device of claim 14 wherein said indicator means provides visual indicator signals including text and graphic information that is indicative of the degree of alignment between the satellite and the signal transmitting device.

16. The device of claim 14 wherein said indicator means provides an audio indicator signal that is indicative of the degree of alignment between the satellite and the signal transmitting device.

17. The device of claim 16 wherein said indicator means provides:

a visual indicator signals including text and graphic information that is indicative of the degree of alignment between the signal transmitting device and the antenna.

18. The device of claim 14 wherein the signal transmitting device comprises a satellite.

19. A device for assessing a degree of alignment of an antenna with a satellite, comprising:

a handheld housing;

a CPU supported within said handheld housing, said CPU coupled to a power supply;

a satellite communications frequency tuner supported within said handheld housing and communicating with said CPU;

a demodulator supported within said handheld housing and communicating with said tuner, said demodulator receiving a data stream from said tuner and extracting a bitstream therefrom and communicating said bitstream to said CPU, wherein said CPU calculates a bit error rate (BER) value of the signal from said bitstream, calculates a carrier to noise (C/N) value of the signal from said bitstream, and calculates an overall quality of signal based on said BER value and said C/N value;

a display supported on said handheld housing and communicating with said CPU for receiving a display signal therefrom, said display visually displays the BER value, the C/N value, and a visual indication of the degree of alignment between the antenna and the satellite based on the calculated overall quality of signal simultaneously;

converter means for converting a digital audio signal generated by said CPU as a result of said bitstream into an analog signal; and speaker means for receiving said analog signal from said converter means and generating a corresponding audio signal.

20. A method for aligning an antenna with a satellite, comprising:

receiving a signal from the satellite;

calculating a BER value of the signal in a portable device;

calculating a C/N value of the signal in the portable device;

calculating an overall quality of signal based on said BER value and said C/N value;

displaying the calculated BER value of the signal, the calculated C/N value, and the calculated overall quality of signal on the portable device simultaneously; and reorienting the antenna until the calculated BER value matches a predetermined BER value.

21. The method of claim 20 further comprising reorienting the antenna until the calculated C/N value matches a predetermined C/N value.

22. A computer-readable medium having stored thereon data and instructions which, when executed by a processor, cause the processor to:

receive a signal from a satellite;

calculate a BER value of the signal;

calculate a C/N value of the signal;

calculate an overall quality of signal based on said BER value and said C/N value; and display the calculated BER value of the signal, the calculated C/N value, and the calculated overall quality of signal on the portable device simultaneously.

* * * * *